US006357198B1

(12) United States Patent
Chevalier

(10) Patent No.: US 6,357,198 B1
(45) Date of Patent: Mar. 19, 2002

(54) METHOD OF MOUNTING CLADDING ON A WALL OF A CABIN ON A SHIP

(75) Inventor: Jean-Claude Chevalier, Ste Anne sur Brivet (FR)

(73) Assignee: Alstom France S.A., Paris (FR)

( * ) Notice: Subject to any disclaimer, the term of this patent is extended or adjusted under 35 U.S.C. 154(b) by 0 days.

(21) Appl. No.: 09/417,066

(22) Filed: Oct. 13, 1999

(30) Foreign Application Priority Data

Oct. 14, 1998 (FR) ..... 98 13042

(51) Int. Cl.[7] ..... E04B 1/00
(52) U.S. Cl. ..... 52/741.1; 52/241; 52/506.06
(58) Field of Search ..... 52/241, 506.07, 52/506.08, 506.01, 506.05, 741.1, 238.1, 506.06, 568, 562, 265, 269

(56) References Cited

U.S. PATENT DOCUMENTS

| | | | | | |
|---|---|---|---|---|---|
| 3,309,826 | A | * | 3/1967 | Zinn | 52/241 |
| 3,481,090 | A | * | 12/1969 | Lizee | 52/241 X |
| 3,685,234 | A | * | 8/1972 | Nelsson | 52/241 X |
| 3,729,883 | A | * | 5/1973 | Thompson | 52/241 X |
| 3,757,480 | A | * | 9/1973 | Young | 52/241 |
| 3,852,926 | A | * | 12/1974 | Papsco | 52/241 |
| 4,361,994 | A | * | 12/1982 | Carver | 52/238.1 |
| 4,458,462 | A | * | 7/1984 | Schold | 52/241 |
| 4,700,515 | A | | 10/1987 | Menchetti | |
| 5,136,822 | A | * | 8/1992 | Blum | 52/241 |
| 5,146,723 | A | * | 9/1992 | Greenwood et al. | 52/241 X |
| 5,245,811 | A | * | 9/1993 | Knorr | 52/238.1 X |
| 5,287,675 | A | * | 2/1994 | McGee | 52/265 X |
| 5,398,473 | A | * | 3/1995 | Chan | 52/506.01 X |
| 5,471,805 | A | * | 12/1995 | Becker | 52/241 |
| 5,644,877 | A | * | 7/1997 | Wood | 52/241 |

FOREIGN PATENT DOCUMENTS

| | | |
|---|---|---|
| DE | 41 16 966 A1 | 11/1992 |
| DE | G 94 02 979.2 | 6/1994 |
| EP | 0 111 857 A1 | 6/1984 |
| GB | 2 160913 A | 1/1986 |
| GB | 2 183 556 A | 6/1987 |

OTHER PUBLICATIONS

Klein Martin, "Einfuhrung in die DIN–Normen", 1961, Teubner B.G. Verlagsgesellschaft, Stuttgart DE XP002108076 pp. 238–239.

* cited by examiner

*Primary Examiner*—Peter M. Cuomo
*Assistant Examiner*—Stephen Vu
(74) *Attorney, Agent, or Firm*—Sughrue Mion, PLLC

(57) ABSTRACT

A method of mounting cladding on an already-installed wall of a cabin of a ship, said cladding being made up of a plurality of panels, said method comprising the following steps:

placing and fixing at least one coupling element at the bottom of said wall;

placing and fixing at least one coupling element at the top of said wall; and placing and fixing said panels successively on said coupling elements.

5 Claims, 2 Drawing Sheets

METHOD OF MOUNTING CLADDING ON A WALL OF A CABIN ON A SHIP

The field of the invention is that of fitting out the interiors of ships.

BACKGROUND OF THE INVENTION

The invention relates to a method of mounting cladding on a wall of a cabin in the living quarters of a ship, and to coupling elements for implementing such a method. For example, such cladding may be constituted by alleyway cladding.

OBJECTS AND SUMMARY OF THE INVENTION

An object of the present invention is to provide a method of mounting cladding on a wall of a cabin of a ship, which method involves implementation costs that are low.

An additional object of the invention is to provide a bottom coupling element and a top coupling element that make it possible to provide constant and uniform spacing between the above-mentioned cladding and the above-mentioned wall.

These various objects and others that appear below are achieved by the invention by means of a method of mounting cladding on an already-installed wall of a cabin of a ship, said cladding being made up of a plurality of panels, said method comprising the following steps:

- placing and fixing at least one coupling element at the bottom of said wall;
- placing and fixing at least one coupling element at the top of said wall; and
- placing and fixing said panels successively on said coupling elements.

The general principle of the invention is thus based on using coupling means to enable panels serving to constitute cladding to be secured to an already-installed wall of a ship's cabin. The use of such coupling means makes it possible to obtain predetermined and constant spacing between the cladding and the wall.

In a preferred implementation of the invention, said cladding constitutes an element of an alleyway on a ship. The method thus makes it possible to equip ships'cabins with alleyway cladding on at least one of their walls. On this subject, it should be noted that, to the best of the Applicant's knowledge, no prefabricated-cabin supplier proposes a cabin design that integrates cladding of the cabin face facing the alleyway into the prefabrication.

In a variant of the method, said already-installed wall is provided with at least one top section member and at least one bottom section member respectively co-operating with said top coupling element and with said bottom coupling element.

The invention also provides a bottom coupling element used for implementing the above-described method. In the invention, said bottom coupling element comprises at least three portions in a plane perpendicular to the cladding, namely:

- a first portion that is substantially vertical and parallel to said panel;
- a spacer second portion that is substantially horizontal and that provides spacing between said wall and said panel; and
- a third portion that is substantially vertical.

Advantageously, said first portion is equipped with fixing means for fixing said bottom coupling element to said panel.

Preferably, said third portion is equipped with fixing means for fixing said bottom coupling element to said wall.

Advantageously, the method further comprises a step of adjusting said top coupling element on said top section member, making it possible to adjust the verticality and the alignment of said panels relative to the same panels of an adjacent cabin.

The invention also covers a top coupling element designed to be used to implement the above-described method. In the invention, said top coupling element comprises at least two portions in a plane perpendicular to said cladding, namely:

- a first portion that is substantially vertical and against which the top portion of said panel bears; and
- a second portion that is substantially horizontal.

The top coupling element and the bottom coupling element are such that they guarantee spacing that is constant and uniform between the cladding and the wall. The spacing between the cladding and the wall depends on the length of the second portion of the bottom coupling element.

It should be noted that the length of the second portion of the top coupling element may be arbitrary. However, the longer this second portion, the better, in particular, it withstands a lateral force.

Advantageously, said first portion is equipped with fixing means for fixing said top coupling element to said panel.

Preferably, said second portion is equipped with fixing means for fixing said top coupling element to said wall.

BRIEF DESCRIPTION OF THE DRAWINGS

Other characteristics and advantages of the invention will appear on reading the following description of a preferred implementation of the invention, given merely by way of non-limiting example and with reference to the accompanying drawings, in which.

MORE DETAILED DESCRIPTION

Figure 2:
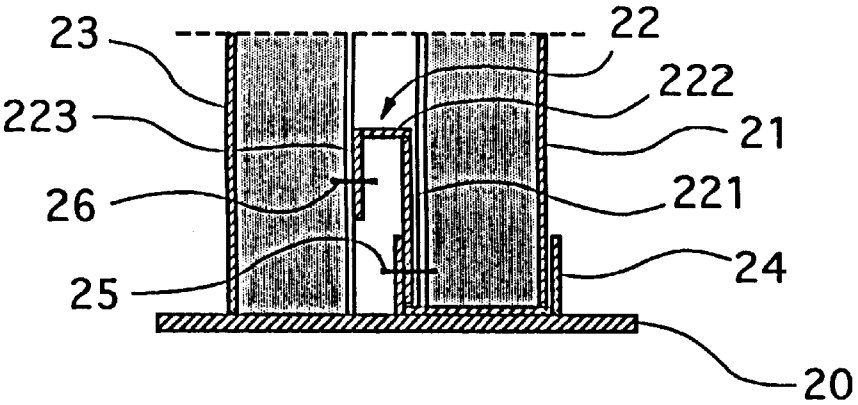
FIG. 2 is a section view of the coupling between a panel of cladding and a wall of a cabin on a ship, at the bottoms of the panel and of the wall.
Figure 3:
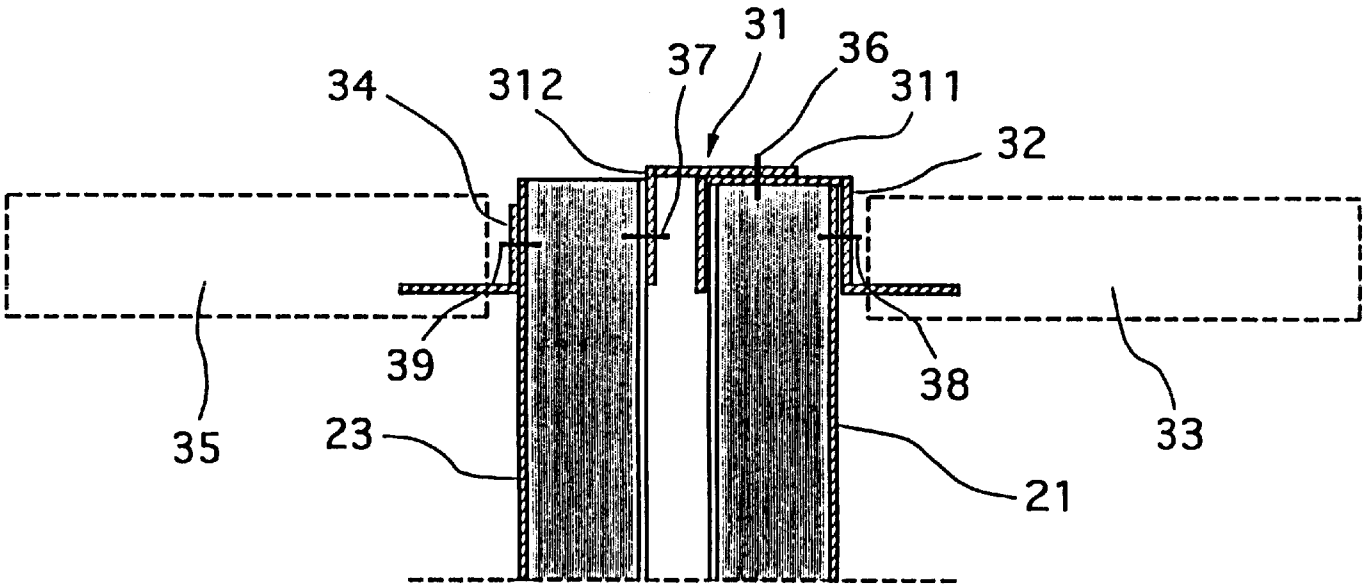
FIG. 3 is a section view of the coupling between a panel of cladding and a wall of a cabin on a ship, at the tops of the panel and of the wall.

The implementation shown in FIGS. 2 and 3 concerns panels 23 that constitute a portion of the cladding of an alleyway of a ship and mounting them on a wall 21 of a cabin of the ship. The wall 21 is already installed, i.e. it is an integral part of ship's cabin. (It should be noted that the method of the invention may be implemented with a ship's cabin that is already installed on board the ship, or with a prefabricated cabin which is not yet installed on the ship).

The cabin wall 21 is provided with a top channel-section member 32 that supports a cabin ceiling 33 by using fixing means 38. At its bottom, the cabin wall is also provided with a bottom channel-section member 24. The cabin rests on a floor 20 (a deck of the ship in this case).

In the invention, at least one coupling element 22 is fixed to the bottom of the cabin wall 21 by using fixing means 25. The element 22 co-operates with the channel-section member 24 into which it can be slid, and it comprises three portions 221, 222, and 223.

At least one top coupling element 31 is then fixed to the top of the cabin wall 21 by using fixing means 36. This element co-operates with the channel-section member 32 and comprises two portions 311 and 312 that define an angle section.

It should be noted that the order in which the top and bottom couplings are fixed is unimportant and, it is naturally possible to fix the top couplings first.

The portion 222 of the bottom coupling and the portion 311 of the top coupling determine the spacing between the cabin wall 21 and the panels 23.

Once the bottom and top couplings have been mounted, a panel 23 is fixed by pressing it against the portion 312 of the top coupling 31 and against the portion 223 of the bottom coupling 22, and by using fixing means 37 and 26. Successive panels may thus be positioned so as to constitute the cladding of an alleyway along a cabin. Once the cladding has been finished, it is possible to put the ceiling 35 of the alleyway in place by using brackets 34 and fixing means 39.

Figure 1:
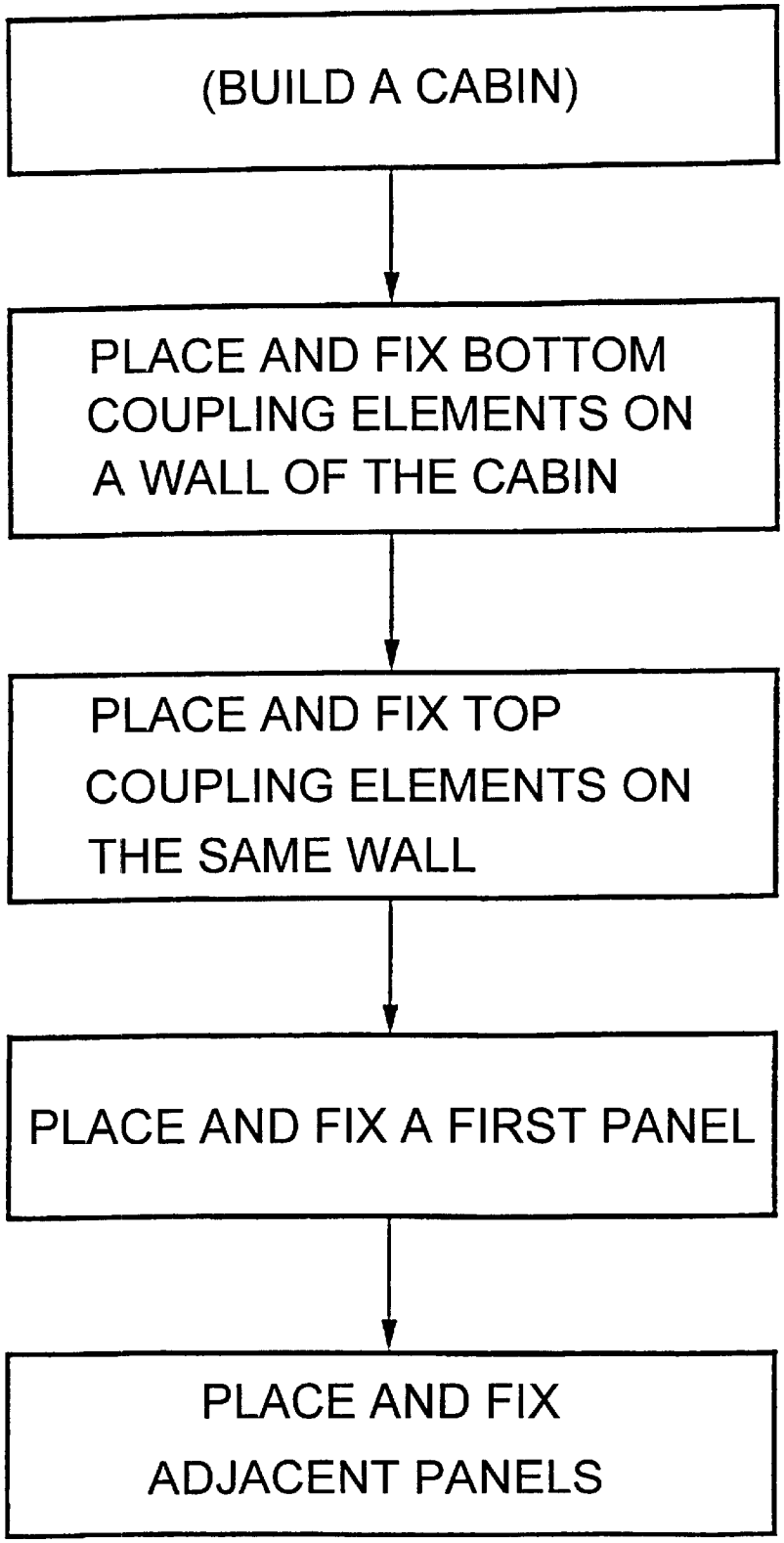
FIG. 1 shows the various steps of a method of the invention.

The various steps of this mounting operation are shown in FIG. 1.

The preferred implementation of the invention shown with reference to FIGS. 1 to 3 in no way limits the scope of the invention. Numerous modifications can thus be made to it without going beyond the ambit of the invention.

What is claimed is:

1. A method of mounting a panel of cladding on a wall of a cabin, said method comprising the steps of:

fixing a bottom coupling element to a bottom of said wall;

fixing a top coupling element to a top of said wall; and fixing said panel to said bottom and said top coupling elements, such that said panel and said wall are substantially parallel to each other and such that said panel completely covers said bottom and said top coupling elements.

2. The method according to claim 1, wherein said cladding constitutes an element of an alleyway.

3. The method according to claim 1, wherein said wall is provided with at least one top section member and at least one bottom section member respectively co-operating with said top coupling element and with said bottom coupling element.

4. The method according to claim 1, wherein only a side of said panel facing said wall is coupled to said top and said bottom coupling elements.

5. The method according to claim 1, further comprising the step of positioning said panel to completely cover said wall.

* * * * *